United States Patent [19]

Gwozdz

[11] Patent Number: 4,683,518

[45] Date of Patent: Jul. 28, 1987

[54] IGNITION FOR OIL BURNER

[75] Inventor: Adam A. Gwozdz, Chicopee, Mass.

[73] Assignee: R. E. Phelon Company, Inc., East Longmeadow, Mass.

[21] Appl. No.: 931,207

[22] Filed: Nov. 17, 1986

[51] Int. Cl.[4] ..... F23Q 3/00

[52] U.S. Cl. ..... 361/263; 336/183; 431/264

[58] Field of Search ..... 361/253, 263; 431/254, 431/255, 258, 78, 264; 336/170, 105, 107, 211, 198, 180, 183

[56] References Cited

U.S. PATENT DOCUMENTS

| | | | |
|---|---|---|---|
| 4,222,089 | 9/1980 | MacAskill, Jr. et al. | 361/263 |
| 4,335,423 | 6/1982 | Koizumi et al. | 336/183 |
| 4,403,943 | 9/1983 | Stella et al. | 431/78 |
| 4,412,269 | 10/1983 | Stella et al. . | |

*Primary Examiner*—Michael L. Gellner
*Assistant Examiner*—David M. Gray
*Attorney, Agent, or Firm*—Chapin, Neal & Dempsey

[57] ABSTRACT

An oil burner ignition system includes a transformer primary winding feedback coil and dual secondary coil wound in axially coextensive and mutually coupled relation about a ferrite core. The primary winding and feedback coil are wound continuously about the core and disposed within a bobbin which supports the secondary coil. The primary and feedback coil have a common end connection in circuit with the emitter of a switching transistor. The other end of the feedback coil is connected through a capacitor and resistor circuit to the base of the transistor. The collector and base of the transistor are connected by a circuit to receive unipolar pulses of electrical energy. A resistor is connected between the base and the collector of the transistor to bias the transistor "on". The feedback coil is disposed to have voltage induced therein by changing current flow through the primary winding and the collector-emitter electrodes of the transistor. The induced voltage is connected to the base of the transistor by the capacitor and resistor circuit to drive the transistor to saturation which causes the transistor to turn "off" with the resulting generation in the secondary coil of an ignition spark.

6 Claims, 3 Drawing Figures

IGNITION FOR OIL BURNER

BACKGROUND OF THE INVENTION

This invention relates to an improved ignition system for oil burners and to a coil/core construction used in the ignition system.

In particular, this invention relates to a coil/core construction in which the primary coil, secondary coil and a feedback coil are all mounted in axially coextensive and magnetically coupled relation radially about a straight ferrite core.

U.S. Pat. Nos. 4,403,943 and 4,412,269 disclose oil burner ignition systems. The former patent discloses a device for oil burners which includes an electrically controlled valve for feeding fuel to the burner. An oscillating circuit connected to a transistor serves to generate the high frequency voltage which is stepped-up by a transformer to generate the ignition spark. The transformer includes a primary coil, secondary coil and two other coils for controlling the operation of the transistor.

The physical arrangement of the transformer is depicted in the U.S. Pat. No. 4,412,269 wherein the secondary coil is wound about a bobbin and fitted about one end portion of an elongated ferrite core. The primary coil 65 is wound on a separate bobbin or reel 64 having a sleeve 66. The core is fitted into the sleeve and magnetically couples the secondary coil and primary which are disposed about different longitudinal portions of the core.

While the above-referenced patents disclose ignition devices for liquid fuel burners which are satisfactory in operation, it is the principal object of this invention to provide an improved ignition of the same general type.

It is another object of this invention to provide an ignition system of the above-type which is more economical to manufacture, more compact in size and has a significantly longer operating life because of its coil/-core construction.

It is a further object of this invention to provide an oil burner ignition system which has fewer parts and is compatible with 110 volt, 60 cycle energy source or other conventional AC power sources.

The above and other objects and advantages of this invention will be more readily apparent from a reading of the following description in conjunction with the accompanying drawings, in which.

Figure 1:
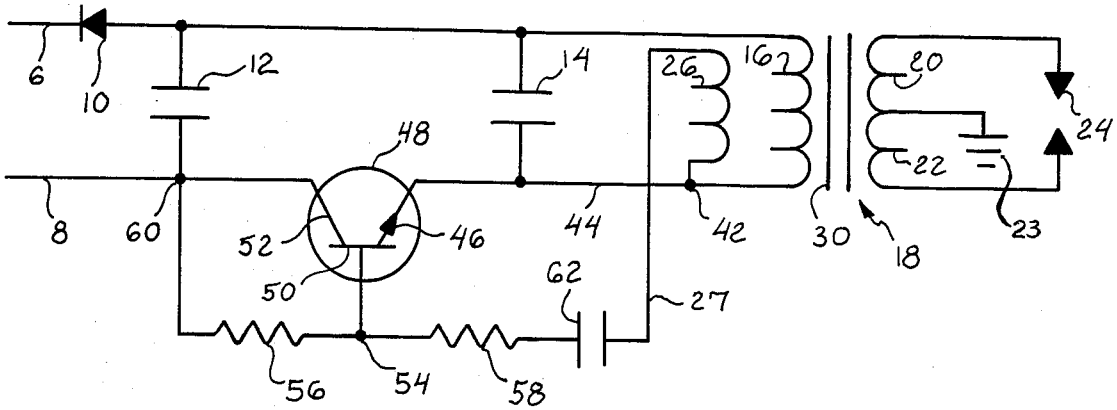
FIG. 1 is a circuit diagram of an ignition system of the type embodying this invention.
Figure 2:
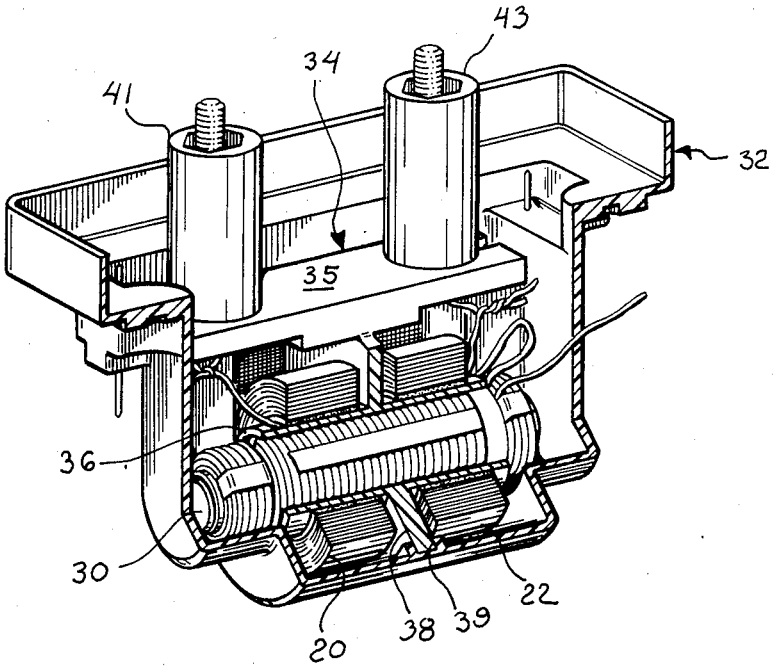
FIG. 2 is a cross-sectional view of the transformer construction which embodies this invention.

Referring in detail to the drawings in FIG. 1, is shown a schematic wiring diagram of a circuit used in my ignition system. The circuit comprises electrical leads 6 and 8 connected to a conventional electrical energy source, such as 110 volts and 60 cycle, alternating current. A blocking diode 10 is connected in line 6, is poled to pass half-wave pulses of the same polarity. A capacitor 12 of about 1 μf is connected across the input conductors and, together with diode 10, serves to increase the energy during ignition by holding the voltage peaks of the alternating pulses on the negative going side of the AC input wave.

A second capacitor 14 of about 0.22 μf is connected across primary winding 16 of an ignition transformer 18. The transformer also includes a dual secondary having two separate windings 20 and 22, each having a ground connection at one end thereof. The high potential ends of secondary coils 20 and 22 are connected to ignition electrodes 24 of the oil burner.

From the one end of the primary 16, a control or feedback coil 26 is wound in closely coupled axially coextensive relation with the primary coil 16. The coils 16, 20, 22 and 26 are all disposed in axially coextensive relation about a cylindrical, straight ferrite core represented at 30 in FIG. 1.

From junction 42, conductor 44 connects to one side of capacitor 14 and the emitter electrode 46 of a high speed, low gain (10–30 HFE) switching transistor 48, such as a 2N6740 of the NPN type which also includes a base 50 and collector electrode 52. The base of the transistor 48 is connected to a junction 54 disposed between resistors 56 and 58. Resistor 56 may have a value of about 70,000 ohms and resistor 58, a value of about 450 ohms. The other end of resistor 56 is connected to junction 60 which is tied to the lower end of capacitor 12. The opposite end of resistor 58 is connected to one side of capacitor 62 and the other side of the capacitor 62 is connected to the end of control or feedback coil 26 opposite its connection 42 to primary coil 16.

The feedback coil 26, which is inductively coupled with the primary coil 16, controls the operation of transistor 48 to form an oscillator circuit which provides high frequency pulses to the electrodes 24 of the oil burner in a manner to be hereinafter more fully described.

In accordance with this invention, the control circuit and transformer are all encapsulated within a dielectric material (not shown) disposed within a synthetic plastic shell 32 including an upwardly opening cavity 33 and a peripheral flange 37.

Figure 3:
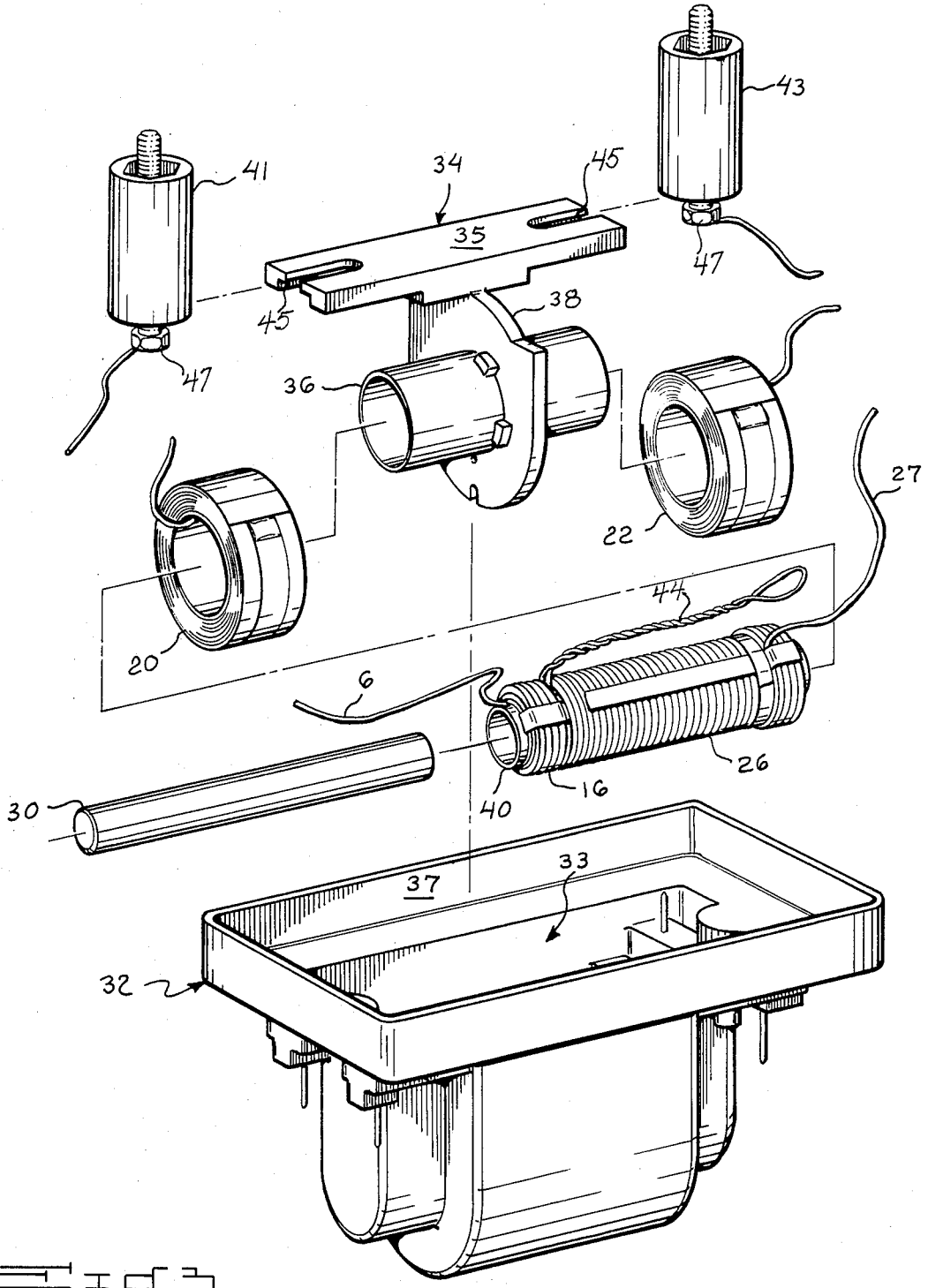
FIG. 3 is an exploded view of the transformer to show its constructional features.

Disposed within the cavity of the shell 32 is a molded plastic bobbin member 34 (FIG. 3) composed of a cylindrical tubular portion 36 and a radially extending flange 38 which is perpendicular and disposed medially of the length of the tubular portion 36. Disposed within the tubular portion is a cylindrical rod 30 of ferromagnetic material which extends from end-to-end thereof.

Fitted closely about the rod 30 is the primary coil 16 which, as shown, is wound about a cylindrical fiberboard or paper sleeve 40. It will be recognized, however, by those skilled in the art that the coil could be made self-supporting. Also wound about the sleeve 40 is feedback coil 26. The primary coil of about 150 turns of #22 copper wire is helically wound continuously in multiple layers on the sleeve 40. Lead wire 44 is connected to the finished end of coil 16 and the start of coil 26. Thereupon, about 70 turns of #22 copper wire are wound directly onto the outer layer of the primary winding 16 from its starting end shown at junction 42 to its finish end which is connected by conductor 27 to capacitor 62. The core and coil assembly may be simply fitted into the open end and tubular portion of bobbin 34. Disposed about the tubular portion 36 of the bobbin, is a paper-wound 12,000 turn, dual secondary coil composed of about 6,000 turns of #44 wire, in each of the two coil portions 20 and 22 disposed on opposite sides of the radial flange 38. These two coils are connected together at their inner ends to ground 23 and at the outer ends to terminals 41 and 43 for connection to electrodes 24.

The assembly, including the core 30, primary winding, feedback coil 26 and secondary coil and premolded mounting bobbin 34, is fitted into the cavity 33 of the shell 32 with the outer edge or flange 38 fitted into a groove channel 39 molded within the shell 32. The leads from the coils are connected to the circuit components which may be either discrete components or disposed on a printed circuit board (not shown) and also disposed within the shell 32.

The high potential leads from the two portions of the secondary coil are connected to ceramic insulated terminals 41 and 43 which are assembled onto a base or horizontal mounting flange 35 using outwardly opening horizontal slots 45 which are adapted to receive screw-fasteners 47 of the terminals. The base 35 is preferably an integral portion of the bobbin 34 and is supported medially by radial flange 38.

The shell may then be filled with a suitable dielectric potting compound, such as a talc filled Epoxy in liquid form, so as to encapsulate entirely both the ignition circuit and transformer.

In operation, the input voltage of 110 V, 60 cycle AC is applied across the input conductors 6 and 8. Diode 10 is a blocking diode to protect transitor 48 from the reverse swing of the input voltage. Capacitor 12, which has a capacitance of about 1 $\mu$f, serves to store some of the input voltage during the turn "on" phase of the transistor 48.

Current of the same polarity pulses flow through the relatively large resistor 56 which, as stated above, may be in the order of 70,000 ohms which results in a very small base-to-emitter turn "on" current through transistor 48. This low energy level turn "on" of transistor 48 results in current flow via the collector-emitter electrodes of the transistor 48 through the primary coil 16 and back to the anode side of the diode 10.

The rapid increase in the rate of current flow in the primary coil 16 causes a voltage to be induced in the closely coupled control or feedback coil 26 and current flows into the base 50 of transistor 48 by way of capacitor 62 and resistor 58. The control coil current causes the transistor 48 to be driven harder with a correspondingly rapid increase in current flow through primary coil 16 and induced voltage in control or feedback coil 26. Such regeneration continues until the transistor reaches a saturated or steady state condition. Saturation will occur at the time that the base current from the control coil times the gain of the transistor ($Ib \times HFE$) becomes greater than the input voltage divided by the impedance of the collector circuit. At saturation, the rate of change of current flowing in primary coil 16 becomes "zero" and the transistor is rendered non-conductive, that is, it turns "off" and remains "off" until the back bias "on" capacitor 62 is discharged through the control coil, emitter 46, base 50 and resistor 58. Another spike or pulse will be initiated as soon as the transistor 48 is again forwardly biased by input current pulses through resistor 56.

When the transistor 48 turns "off" there is an open circuit collapse of current flow in the primary which induces a large voltage in the secondary coils 20 and 22 to provide ignition pulses at the electrodes 24.

The capacitor 14, connected across primary coil 16, provides a ring-back path for the primary and allows the primary to oscillate by alternately charging and discharging capacitor 14. This arrangement results in ignition pulses of greater spark duration.

A tank circuit including capacitor 14, primary coil 16, as well as the feedback circuit consisting of control coil 26 and capacitor 62, determine the 20 KHZ frequency that modulates the input AC half-wave pulses.

Energy requirements were measured by pulsing various high voltage transformers until fuel was ignited at all conditions in compliance with U.L. specifications. Based on these measurements, a transformer was selected with 150 turns of #22 wire for the primary winding, a feedback coil of 70 turns of #22 wire and a secondary winding of 12,000 turns of #44 wire. This transformer will meet all energy requirements when 90–130 volts AC half-wave pulses are modulated at 20,000 HTZ. Peak excitation current/rise time and induced voltage on the primary winding were used to select a proper switching transistor having a gain of 10–30. To get 3.5 amps at 8 $\mu$sec. rise time and 20,000 HTZ frequency at 90–130 volts half-wave AC input, it was found that a feedback coil of about 70 turns was needed.

Having thus described my invention, what is claimed is:

1. Oil burner igniter having a transformer with a primary winding and secondary winding connected to electrodes for providing an ignition spark, a feedback coil is inductively coupled to the primary coil and a transistor is connected in circuit with an input energy source and the primary coil, the improvement comprising said primary winding and feedback coil being continuously wound and disposed about the circumference of a ferromagnetic core, a secondary winding disposed about the circumference of the primary winding and feedback coil in inductively coupled radial relationship, said primary winding, feedback coil and secondary coil all being disposed in axially coextensive relation about said core.

2. Oil burner igniter as set forth in claim 1, wherein said primary winding is composed of approximately 150 turns and said feedback coil has about 70 turns.

3. Oil burner igniter as set forth in claim 1, in which said feedback coil is connected in circuit with the base and emitter of said transistor, a first resistor connected between the collector and base of said transistor for biasing said transistor to a conducting mode, the feedback coil circuit including a second resistor of substantially lower resistance than the first resistor, being adapted to be charged to a back bias voltage by current induced in the feedback coil, said feedback coil serving to drive said transistor to its saturation point at which it turns "off" and being held in a non-conducting state by said back bias voltage until the same is discharged through the second resistor, and the base-emitter of said transistor.

4. Oil burner ignition as set forth in claim 2, in which said secondary is comprised of two separate paper-wound coil portions of approximately an equal number of turns, a bobbin having a tubular opening into which the primary winding, feedback coil and core are disposed in axially coextensive relation, said bobbin including a radial flange disposed perpendicular to and medially of the length of said bobbin, one of said secondary coil portions being disposed on each side of said flange, said transformer and feedback coil being disposed in the cavity of an upwardly opening synthetic plastic shell and being encapsulated therein by a cured, dielectric material which fills said shell in liquid form.

5. Oil burner ignition as set forth in claim 4, in which said bobbin includes a base member integrally disposed on an outer edge portion of said radial flange, said base extending in generally parallel spaced relation to the tubular portion of said bobbin, said base member being provided with mounting slots for retaining insulated terminals connected to the secondary winding disposed on said bobbin.

6. Oil burner ignition as set forth in claim 4, in which each of said terminals includes a stud with a ceramic insulator disposed thereon, said base being generally horizontal, and in which said slots "open" outwardly on opposite outer end portions of the base, said studs being disposed in said slots with the ceramic insulators supported on the horizontal outer surface of said base.

* * * * *